US007495536B2

(12) United States Patent
Keller et al.

(10) Patent No.: US 7,495,536 B2
(45) Date of Patent: Feb. 24, 2009

(54) MAGNETIC ACTUATOR FOR DIRECT GENERATION OF A ROTARY ACTUATION OF A SHAFT WITH CURRENTLESS FIXATION OF THE STOP POSITION

(75) Inventors: Reiner Keller, Bodmann-Ludwigshafen (DE); Michael Pantke, Friedrichshafen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 11/831,046

(22) Filed: Jul. 31, 2007

(65) Prior Publication Data

US 2008/0030291 A1 Feb. 7, 2008

(30) Foreign Application Priority Data

Aug. 5, 2006 (DE) ..... 10 2006 036 685

(51) Int. Cl.
*H01F 7/00* (2006.01)

(52) U.S. Cl. ..... 335/229; 335/234

(58) Field of Classification Search ..... 335/229–234, 335/272; 310/36

See application file for complete search history.

(56) References Cited

FOREIGN PATENT DOCUMENTS

| | | | |
|---|---|---|---|
| DE | 196 03 306 A1 | | 7/1997 |
| DE | 196 34 764 A1 | | 3/1998 |
| DE | 202 03 718 U1 | | 8/2002 |
| DE | 102 07 828 A1 | | 9/2003 |
| JP | 2003227456 A | * | 8/2003 |

* cited by examiner

*Primary Examiner*—Ramon M Barrera
(74) *Attorney, Agent, or Firm*—Davis Bujold P.L.L.C.

(57) ABSTRACT

A magnetic actuator for the direct generation of a rotary actuation of a shaft (1) with currentless stop position fixation is proposed, which comprises at least one permanent magnetic anchor (2) configured as an annular segment and torque-proof connected to the shaft (1) and at least two electromagnet systems (7, 8), which each have a coil (5, 6) wound around a ferromagnetic core (3, 4), wherein the at least two electromagnet systems (7, 8) and the at least one permanent magnetic anchor (2) are arranged in a non-magnetic pole conduit (10) or on a circular path configured as an annular segment or as a ring co-axially with respect to the rotating shaft (1), the at least one permanent magnetic anchor (2) is arranged between two electromagnet systems (7, 8), and the length of the circular segment between the electromagnet systems (7, 8) is greater than the length of the anchor (2) arranged between the electromagnet systems (7, 8) in peripheral direction in order to make possible a motion of the anchor (2) along a circular path segment between the electromagnet systems (7, 8) corresponding to their current feed.

10 Claims, 2 Drawing Sheets

MAGNETIC ACTUATOR FOR DIRECT GENERATION OF A ROTARY ACTUATION OF A SHAFT WITH CURRENTLESS FIXATION OF THE STOP POSITION

This application claims priority from German Application Serial No. 10 2006 036 685.9 filed Aug. 5, 2006.

FIELD OF THE INVENTION

The invention concerns a magnetic actuator for direct generation of a rotary actuation of a shaft with a currentless fixation of the stop position.

BACKGROUND OF THE INVENTION

So-called bistable solenoid magnets are particularly suitable for the magnetic adjustment of two positions and the currentless fixation of the respective stop position. These magnets are especially characterized in that the anchor is configured as a permanent magnet, which makes a currentless retention of the stop position possible.

DE 102 07 828 B4 describes an electromagnetic solenoid magnet consisting of at least one magnet system, having a stator and a field coil for generating an electromagnetic field and an anchor lying opposite the magnet system, which acts on a mechanical transmission element and supports a permanent magnet arrangement that is vertically polarized with respect to its motion direction for permanent retention without current of the anchor in at least one of its stop positions of the field coil by closing the permanent magnetic retention flow, via the stator of the magnet system. The solenoid magnet preferably has two mutually axially spaced and preferably magnetically separated magnetic systems, between which the anchor is guided.

DE 202 03 718 U1 describes an electromagnetic control apparatus, having an actuator, which is movable within a housing against a stop and can be configured as a piston arrangement and a coil arrangement that is stationary, relative to the actuator, and provided for exerting a bidirectional force on the actuator. In the electromagnetic control apparatus, the actuator has permanent magnetic means, at least in some sections, and the coil arrangement is wired as a dual pole and is configured for simultaneously co-acting with both poles of the permanent magnetic means in such a way that, in a first control state of the coil means, the latter moves the actuator into a first stop position within the housing. In a second control state of the coil means, the latter moves the actuator into a second stop position, which lies opposite to the first stop position within the housing, where the first and the second control states provide a short-term, especially single pulse-shaped current supply of the coil means, and the actuator remains in a currentless state that follows the first or second control state of the control means.

A mechanism that converts linear motion into rotary motion is always disadvantageously required, however, in order to adjust rotary motion with two stop positions with the bistable solenoid magnets, known from the state of the art.

It is an object of the invention to disclose a magnetic actuator based on the mentioned state of the art, which enables direct rotary adjusting motion of a shaft, i.e., without mechanical conversion of axial motion into rotary motion in which currentless retention of each stop position is possible.

In particular, a bistable rotary actuator without additional mechanics should be disclosed.

SUMMARY OF THE INVENTION

A magnetic actuator for direct generation of a rotary adjusting motion of a shaft with currentless stop position fixation is accordingly proposed, which has at least one permanent magnetic anchor, configured as a ring segment and is connected in a rotationally fixed manner to the shaft to be rotated and at least two electromagnet systems, which have respectively one coil that is wound around at least two electromagnet systems which, in turn, have a coil that is wound around a ferromagnetic core, while the at least two electromagnet systems and the at least one permanent magnet anchor are arranged in a non-magnetic pole conduit or on a circular path configured as an annular segment or as a ring co-axially with respect to the rotating shaft.

According to the invention, the at least one permanent magnetic anchor is arranged between two electromagnet systems, wherein the length of the circular path segment, between the electromagnet systems, is greater in the peripheral direction than the length of the anchors, arranged between the electromagnet systems, in order to make a motion of the anchor possible (and thus of the shaft connected to the anchor) along a circular path segment between the electromagnet systems corresponding to their current feed.

The coils of the electromagnet systems can be provided with current from alternating directions, whereby the force action of the coils is added. The permanent magnetic anchor is retained in the respective stop position on the respective ferromagnetic core of the currentless coil on which it rests.

The advantage that the rotary circular motion can be directly generated without a mechanical element and while retaining all the advantages of a linear bistable solenoid magnet, such as the currentless stop position fixation, the small required installation space, etc., is created by way of the conception of the bistable rotary magnetic actuator. A further advantage of the invention is the current feed of the coils from alternating directions that is made possible, which results in an increase of the force yield and, in addition, reduces the installation space requirements.

BRIEF DESCRIPTION OF THE DRAWINGS

The invention will now be described, by way of example, with reference to the accompanying drawings in which.

DETAILED DESCRIPTION OF THE INVENTION

Figure 1:
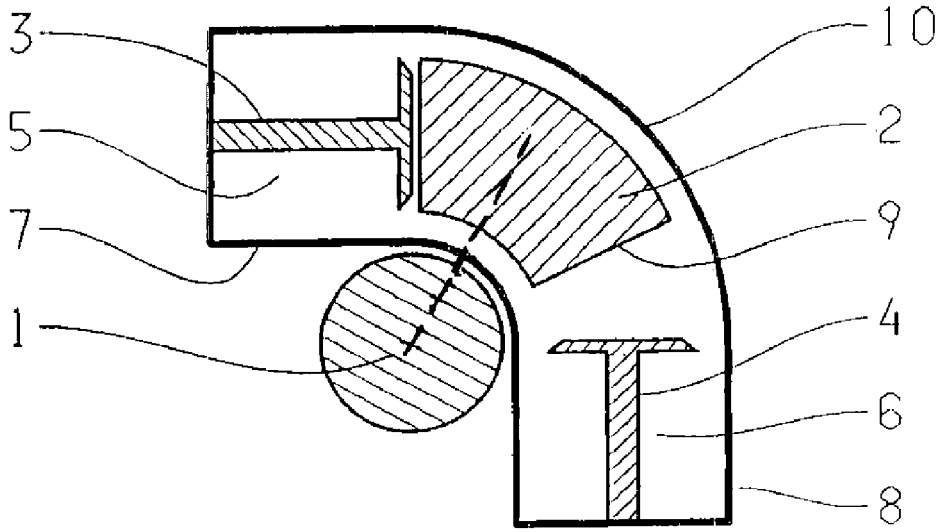
FIG. 1 shows a schematic representation of an actuator according to a first embodiment of the invention.

FIG. 1 shows an actuator for making a direct rotary actuation of a shaft 1 possible. It comprises a permanent magnetic anchor 2 enclosed by a flow guiding plate 9 for the magnetic flow, which is configured as an annular segment and is fixedly connected to the shaft 1. The actuator also includes two electromagnet systems 7, 8, each having a coil 5, 6 wound around a ferromagnetic core 3, 4.

As can be seen in FIG. 1, the electromagnet systems 7, 8 and the permanent magnetic anchor 2 are arranged in a magnetically conducting pole conduit 10 configured as an annular segment or are arranged on a circular path co-axially with regard to the shaft 1, while the permanent magnetic anchor 2 is arranged between the two electromagnet systems 7, 8. The length of the circular segment between the two electromagnet systems 7, 8 is greater herein than the length of the anchor 2 in the peripheral direction in order to make a motion of the anchor 2 possible along a circular path segment between the electromagnet systems 7, 8 corresponding to their current feed.

A magnetic field is built up by way of a corresponding current feed of the coils 5, 6 of the electromagnetic systems 7, 8, which results in motion of the anchor 2 and, consequently, of the shaft 1 that is connected in a rotationally fixed manner along a circular segment. At the corresponding stop position, the permanent magnetic anchor 2 is attracted by the ferromagnetic core 3 or 4 of the currentless coil 5 or 6 on which the anchor 2 rests, whereby currentless retention of each stop position is possible.

This arrangement makes delivering a current to the coils 5 and 6 from alternating directions possible, where the force actions of both coils 5, 6 are added. This fundamental principle is illustrated in FIG. 2.

Figure 2:
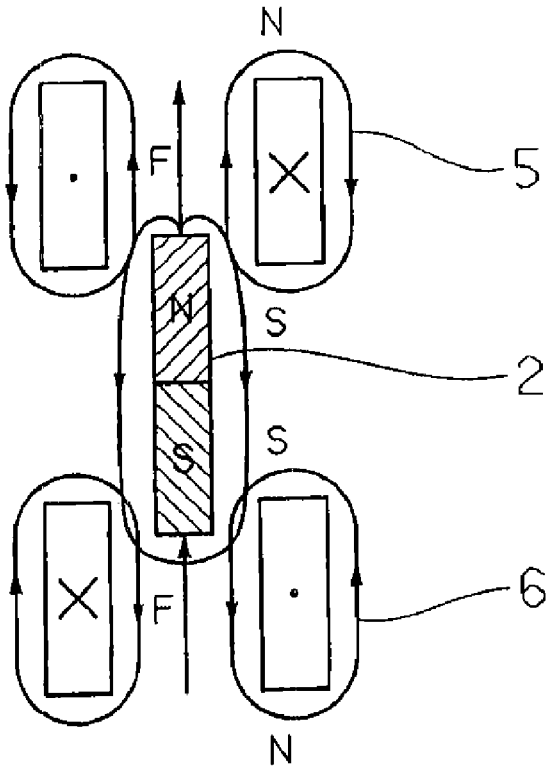
FIG. 2 shows a schematic representation of the force acting on the magnetic anchor of the actuator with a current feeding of the coils from alternating directions.

FIG. 2 shows a permanent magnetic anchor 2, which can be moved axially between the coils by way of magnetic forces F depending on the current delivered to the coils 5, 6. The force acting on the anchor 2, is doubled through the current delivered to the coils 5, 6 from different directions. In the shown example, both coils are provided with current from alternating directions so that the north pole N of the anchor 2, which faces toward the coil 5, is attracted by the south pole S of the coil 5 while, at the same time, the south pole S of the anchor 2, which faces toward the coil 6, is repelled by the south pole S of the coil 5.

It is also possible to provide the actuator with several permanent magnetic anchors, which are configured as an annular segment and are connected in a rotationally fixed manner to the rotational shaft. An example of such an arrangement is shown in FIG. 3.

The actuator comprises two mutually diametrically opposite lying permanent magnetic anchors 2, 2', which are connected in a rotationally fixed manner to the shaft 1, and are respectively located in a circular-shaped, pole conduit 10 arranged co-axially with regard to the shaft 1, between two mutually diametrically opposite lying electromagnet systems 7, 8. The electromagnet systems 7, 8 each have a coil 5, 6 wound around a ferromagnetic core 3,4. (In the peripheral direction of the circular-shaped pole conduit 10, an anchor and an electromagnet system are alternatively arranged). Permanent magnetic anchors 2, 2' are provided with an antipodal magnetization.

Similarly as in the embodiment of FIG. 1, the length of the circular segment, between the two electromagnet systems 7, 8, is greater than the length of the anchors 2, 2' in the peripheral direction, in order to make motion of the anchor 2, 2' possible, along a circular path between the electromagnet systems 7, 8.

Figure 3:
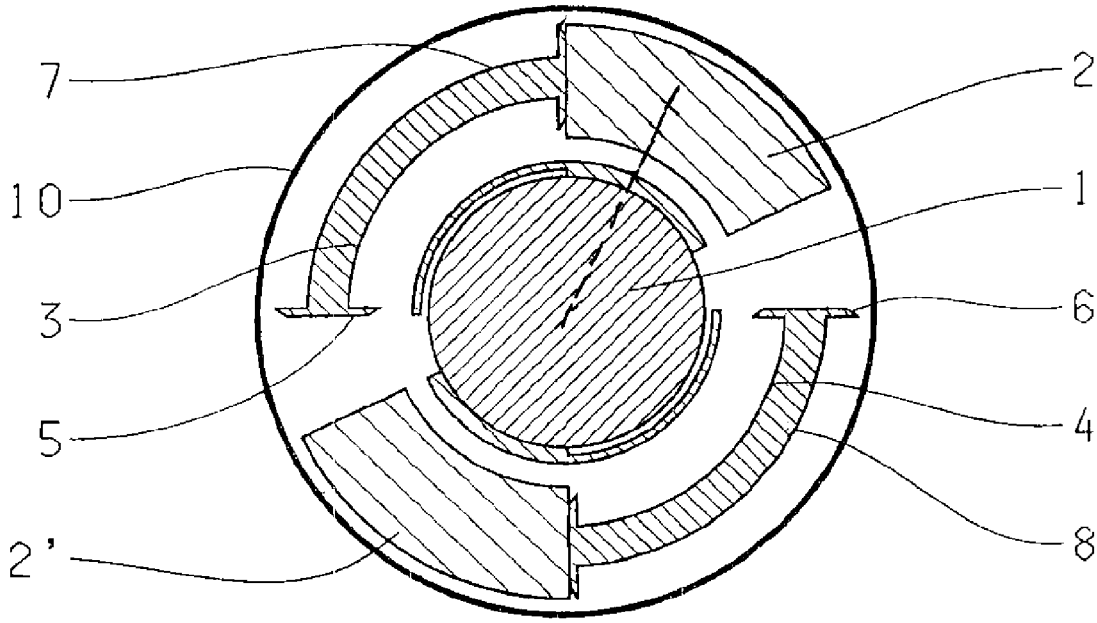
FIG. 3 shows a schematic representation of a further embodiment of an actuator according to the invention.

A further increase of the rotary force, in comparison with the embodiment of FIG. 1, is achieved by way of the arrangement shown in FIG. 3, since the magnetic forces act simultaneously on two anchors 2, 2' without increasing the number of electromagnet systems.

Within the scope of further embodiments of the invention, which are not depicted, the actuator is provided with an even number (2*n, n=1, 2, 3, . . . , etc.) of annular segments and magnetic anchors, which are connected in a rotationally fixed manner to the shaft that is to be rotated and comprises the same even number of electromagnet systems, while the anchors are arranged in the peripheral direction of a circular-shaped pole conduit, which is co-axially arranged between two electromagnet systems with regard to the shaft that is to be rotated. Two anchors, which are arranged mutually consecutively in the peripheral direction, are provided with an antipodal magnetization.

With an equal odd number (2*n+1, n=1, 2, 3, . . . ) of anchors and electromagnet systems, a device for shielding the magnetic field must be arranged between an anchor and an electromagnet system.

It is understood that also any other constructive configuration, especially any arrangement in space of the components of the actuator, alone or in combination as long as it is technically practical, is included within the scope of the claims, without influencing the function of the actuator as it is disclosed in the claims, even if these configurations are not explicitly represented in the Figures or described in the specification.

REFERENCE NUMERALS

1 shaft
2 permanent magnetic anchor
2' permanent magnetic anchor
3 ferromagnetic core
4 ferromagnetic core
5 coil
6 coil
7 electromagnet system
8 electromagnet system
9 flow guiding plate
10 pole conduit
F magnetic force
N north pole
S south pole

The invention claimed is:

1. A magnetic actuator for directly generating rotary actuation of a shaft (1) with currentless stop position fixation, the magnetic actuator comprising:

at least one permanent magnetic anchor (2) being directly connected to the shaft (1) in a rotationally fixed manner, and the permanent magnetic anchor (2) being an annular segment; and at least two electromagnet systems (7, 8) each having a coil (5, 6) wound around a ferromagnetic core (3, 4), the two electromagnet systems (7, 8) and the permanent magnetic anchor (2) are located within a non-magnetic pole conduit (10) along a circular path and co-axial with respect to the rotating shaft (1);

wherein the permanent magnetic anchor (2) is arranged between the two electromagnet systems (7, 8); and a length of an annular segment of the circular path, between the two electromagnet systems (7, 8), is greater than a length of the permanent magnetic anchor (2), arranged between the electromagnet systems (7, 8), in a peripheral direction, so to enable the permanent magnetic anchor (2) to travel about the circular path between the electromagnet systems (7, 8), depending on a flow electrical current.

2. The magnetic actuator according to claim 1, wherein the ferromagnetic core (3, 4) of the currentless coil (5, 6) attracts the permanent magnetic anchor (2), which is connected to the shaft (1) in a rotationally fixed manner, to currentlessly retain the magnetic anchor (2) in the respective stop position.

3. The magnetic actuator according to claim 1, further comprises an even number (2*n, n=1, 2, 3, . . . , etc.) of annular segments and magnetic anchors (2, 2') which are connected to the shaft (1), in a rotationally fixed manner, that is to be rotated, and the same even number of electromagnet systems (7, 8), in which the magnetic anchors (2, 2') are arranged in the peripheral direction of the pole conduit (10), which is co-axially arranged between electromagnet systems (7, 8) with regard to the shaft that is to be rotated, and in which the magnet anchors (2, 2'), which are arranged mutually consecutively in the peripheral direction, are provided with an antipodal magnetization.

4. The magnetic actuator according to claim 1, further comprising an equal odd number (2*n+1, n=1, 2, 3, . . . ) of annular segments and magnetic anchors (2, 2'), which are connected to the shaft (1), in a rotationally fixed manner, that is to be rotated, and the same even number of electromagnet systems (7, 8), in which the magnetic anchors (2, 2') are arranged in the peripheral direction of the pole conduit (10), which is co-axially arranged between electromagnet systems (7, 8) with regard to the shaft (1) that is to be rotated, and a device for shielding the magnetic field is located between an anchor and an electromagnet system.

5. The magnetic actuator according to claim 1, wherein the coils (5, 6) of each of the electromagnet systems (7, 8) receive current from different directions, such that a force action of the coils (5, 6) is added to a rotary force of the actuator.

6. The magnetic actuator according to claim 1, wherein the shaft (1) is also located within the circular-shaped pole conduit (10).

7. The magnetic actuator according to claim 1, wherein a pair of opposed permanent magnetic anchors (2) are each directly connected to the shaft (1) in a rotationally fixed manner.

8. The magnetic actuator according to claim 1, wherein the pole conduit (10) is a circular-shaped pole conduit (10).

9. A magnetic actuator for directly generating rotary actuation of a shaft (1) with currentless stop position fixation, the magnetic actuator comprising:

at least one permanent magnetic anchor (2) being connected to the shaft (1) in a rotationally fixed manner, and the permanent magnetic anchor (2) being an annular segment; and a least two electromagnets stems (7, 8) each having a coil (5, 6) wound around a ferromagnetic core (3, 4), the two electromagnet systems (7, 8) and the permanent magnetic anchor(2) are one of configured within a non-magnetic pole conduit (10), about a circular path as an annular segment, and as a ring co-axial with respect to the rotating shaft (1);

wherein the permanent magnetic anchor (2) is arranged between the two electromagnet systems (7, 8); a length of the annular segment of the circular path, between the two electromagnet systems (7, 8), is greater than a length of the permanent magnetic anchor (2), arranged between the electromagnet systems (7, 8), in a peripheral direction, so to enable the permanent magnetic anchor (2) to travel about the circular path segment between the electromagnet systems (7, 8), depending on a flow electrical current; and the magnetic actuator comprises two mutually diametrically opposite permanent magnetic anchors (2, 2') which are each connected to the shaft (1) in a rotationally fixed manner, are respectively arranged in the circular-shaped pole conduit (10), and are arranged co-axially with respect to the shaft (1) between the electromagnet systems (7, 8) which are diametrically opposite, while the two permanent magnetic anchors (2, 2)' are provided with an antipodal magnetization.

10. A magnetic actuator for directly actuating rotational movement of a shaft (1) between at least two positions, at which the rotational movement of the shaft (1) stops, the magnetic actuator comprising:

at least one permanent magnetic anchor (2) being rotationally fixed to the shaft (1) and being formed as segment of a ring;

at least two electromagnet systems (7, 8), each of the at least two electromagnet systems (7, 8) having a coil (5, 6) wound around a ferromagnetic core (3, 4), the electromagnet systems (7, 8) and the anchor (2) extend in a circular path about the shaft (1) within a non-magnetic pole conduit (10), and the circular path of the conduit (10) and the shaft (1) are co-axial with one another;

the magnetic anchor (2) is located within the circular conduit (10) between the two electromagnet systems (7, 8), and has a radial length shorter than a radial distance between the two electromagnet systems (7, 8) such that the magnetic anchor (2) and the shaft (1) fixed thereto travels about the circular path of the conduit (10) between the two electromagnet systems (7, 8); and the magnetic anchor (2) has at least one stop position in which rotational movement of the anchor (2) ceases, and when electrical current to the coils (5, 6) is turned off, the magnet of the magnetic anchor (2) is magnetically attracted to the ferromagnetic core (3, 4) of the two electromagnet systems (7, 8) to thus prevent rotation of the magnetic anchor (2).

* * * * *